US005579957A

United States Patent [19]

Gentile et al.

[11] Patent Number: 5,579,957

[45] Date of Patent: Dec. 3, 1996

[54] CHILD-RESISTANT CLOSURE

[75] Inventors: James Gentile, Orange; John Bengston, Ridgefield; Dean Rainey, Clinton; John Eimer, Danbury, all of Conn.; Alfred G. Zammit, Mississauga, Canada

[73] Assignee: Chesebrough-Pond's USA Co., Division of Conopco, Inc., Greenwich, Conn.

[21] Appl. No.: 429,271

[22] Filed: Apr. 25, 1995

[51] Int. Cl.[6] ..... B67D 5/33

[52] U.S. Cl. ..... 222/153.14; 222/556; 215/237

[58] Field of Search ..... 222/153.14, 485, 222/484, 498, 546, 556; 215/237, 241, 242

[56] References Cited

U.S. PATENT DOCUMENTS

| | | | |
|---|---|---|---|
| 4,022,352 | 5/1977 | Pehr . | |
| 4,127,221 | 11/1978 | Vere . | |
| 4,154,353 | 5/1979 | Hoo . | |
| 4,244,495 | 1/1981 | Lorscheid et al. . | |
| 4,353,483 | 10/1982 | Pehr . | |
| 4,513,888 | 4/1985 | Curry | 222/153.14 |
| 4,787,526 | 11/1988 | Pehr . | |
| 4,852,770 | 8/1989 | Sledge et al. . | |
| 4,925,041 | 5/1990 | Pehr . | |
| 4,974,735 | 12/1990 | Newell et al. | 215/237 |
| 5,013,073 | 5/1991 | Pehr . | |
| 5,031,784 | 7/1991 | Wright | 215/237 |
| 5,137,260 | 8/1992 | Pehr . | |
| 5,252,312 | 10/1993 | Gentile et al. . | |
| 5,289,950 | 3/1994 | Gentile . | |
| 5,356,017 | 10/1994 | Rohr et al. . | |

FOREIGN PATENT DOCUMENTS

| | | | |
|---|---|---|---|
| 547978 | 6/1993 | European Pat. Off. | 222/556 |
| 2166123 | 4/1986 | United Kingdom | 222/556 |
| 2041891 | 9/1990 | United Kingdom | 222/556 |

*Primary Examiner*—Andres Kashnikow
*Assistant Examiner*—Philippe Derakshani
*Attorney, Agent, or Firm*—Milton L. Honig

[57] ABSTRACT

A dispensing package is provided with a container and a cap. The cap includes a mechanism to fittingly engage across an open end of the container, a top portion defined by a deck, a skirt wall surrounding the deck, at least one dispensing orifice formed in the deck, a locking aperture with a wide and a narrow area preferably in a T-shape, a lid hingedly attached to the deck, a flexible post projecting downwardly from the lid, and a release mechanism along the skirt. The flexible post has an enlarged section at an end thereof which can lockingly engage underneath landings that define wide and narrow areas of the locking aperture. A flexible area along the skirt can be pushed inward against the enlarged section of the post to dislodge same from underneath the landings thereby opening the lid.

15 Claims, 5 Drawing Sheets

CHILD-RESISTANT CLOSURE

BACKGROUND OF THE INVENTION

1. Field of the Invention

The invention concerns a child-resistant closure for use on a cap of a container capable of dispensing fluids.

2. The Related Art

Unattended children have been accidentally poisoned or injured when curiosity has led them to sample household products. Toxic products have included bleaches, drain cleaners, detergents and candy resembling pills. Government regulations have been issued requiring childproof packaging for many of these hazardous substances.

Engineering a child-resistant closure presents many challenges. Not only must the safety device hinder opening by a child but it must nevertheless be openable by adults having limited manual dexterity. Access must be designed for the older group who may be suffering from arthritis, age-induced loss of strength or other causes lessening their dexterity. Simply stated, an engineer is presented with an external tight performance brief.

A multi-chamber dispensing package for a mouthrinse to separately store peroxide and bicarbonate solutions and simultaneously dispense both streams has been under development for several years. Challenges in this area have been met through inventions described in U.S. Pat. No. 5,289,950 and U.S. Pat. No. 5,252,312, both to Gentile. Ethanol, a potentially hazardous substance, is a common ingredient in mouthrinses. Government regulations will soon require childproof caps on certain ethanol containing mouthrinse products such as proposed for dispensing in the aforementioned multiple chamber package. Up to the present, there has been no suitable packaging technology available.

The literature has recorded a variety of child-resistant closure systems. For instance, U.S. Pat. No. 4,852,770 (Sledge et al.) describes a closure having a base portion and a cap hingedly connected thereto. An elongated, flexible, resilient post extends upwardly from the base with an enlarged upper end. When the cap is brought towards a closed position, the elongated upper end passes through an aperture in the cap top wall and assumes an orientation which interferes with opening of the cap. A similar concept is described in each of U.S. Pat. No. 4,127,221 (Vere), U.S. Pat. No. 5,137,260 (Pehr), U.S. Pat. No. 5,356,017 (Rohr) and U.S. Pat. No. 4,925,041 (Pehr) wherein a flexible upright locking lever or tongue is tensioned to fit through an opening in a covering cap.

Another approach is illustrated in U.S. Pat. No. 4,022,352 (Pehr) and U.S. Pat. No. 4,244,495 (Lorscheid et al.). These patents employ a cap or lid hingedly attached to a base. A resilient latch or tongue formed on the cap or lid is oriented downwardly to retainingly engage a cooperating latching device formed in the base.

A problem with many of the known devices is that they are either insufficiently childproof or too difficult for an older adult to open. Another problem is that some of the devices are insufficiently liquid leak proof, the result of which causes product spillage during shipping and handling.

Accordingly, it is an object of the present invention to provide a child-resistant closure which passes government standards.

It is another object of the present invention to provide a child-resistant closure that seals sufficiently to prevent product leakage during shipping and handling.

SUMMARY OF THE INVENTION

A dispensing package is provided including:

a container with a closed and an open end for storing a product; and a cap fitting across the open end of the container, the cap including:

- a base portion with a mechanism to fittingly engage across the open end of the container;
- a top portion over the base portion having a deck along an upper surface thereof with front and rear edges;
- a skirt wall surrounding the deck;
- at least one dispensing orifice formed in the deck for allowing the product to be dispensed therethrough;
- a locking aperture formed in the deck having a wide first area and a narrow second area;
- a lid with a front and a rear end, the rear end being hingedly attached to the base portion;
- a flexible post with first and second ends, the first end being attached to the lid, the post projecting downwardly and formed at the second end being formed with an enlarged section with a size too wide to fit laterally within the narrow second area of the locking aperture, the post being adapted to move resiliently in a flexing direction as the lid is closed to reach a locked position wherein the enlarged section is lockingly received below the narrow second area; and
- a release mechanism along the skirt for deflecting the enlarged section in the flexing direction to disengage same from below the landings.

In a preferred embodiment, the post will be T-shaped and the locking aperture will be a congruent T-shaped cutout. The narrow second area can be defined by a pair of flanking landings formed wthin the aperture. Each of the landings will have an upper surface bevelled downwardly away from the deck. A bevelled terminis is advantageously fashioned along an outer engaging end of the enlarged section of the flexible post. The bevelled landings and bevelled terminus of the enlarged section of the post should be sufficiently complimentary to allow for alignment and facile sliding engagement therebetween.

In the preferred embodiment, the post is defined by four flat surfaced sides. Further, the locking aperture is positioned adjacent the front edge of the deck. The release mechanism is on an area of the skirt wall partially severed therefrom along a cut-line. The cut-line includes a horizontal cut parallel to the front edge of the deck and a pair of parallel vertical cuts perpendicularly intersecting ends of the horizontal cut.

The deck of the preferred embodiment is angled downwardly from rear to front edges. The lid further includes a skirt surrounding a top wall, the post being attached to this lid skirt. A leading edge of the top wall projects outwardly over the lid skirt. At least one projection of the lid is oriented downward to engage at least one recess formed in the deck.

The dispensing orifice is encompassed by a downwardly oriented sleeve, the locking aperture being outside the encompassed sleeve.

BRIEF DESCRIPTION OF THE DRAWINGS

Other objects, advantages and features of the present invention will become more readily apparent from the following detailed description of the invention, including the accompanying drawings in which.

DETAILED DESCRIPTION

Figure 1:
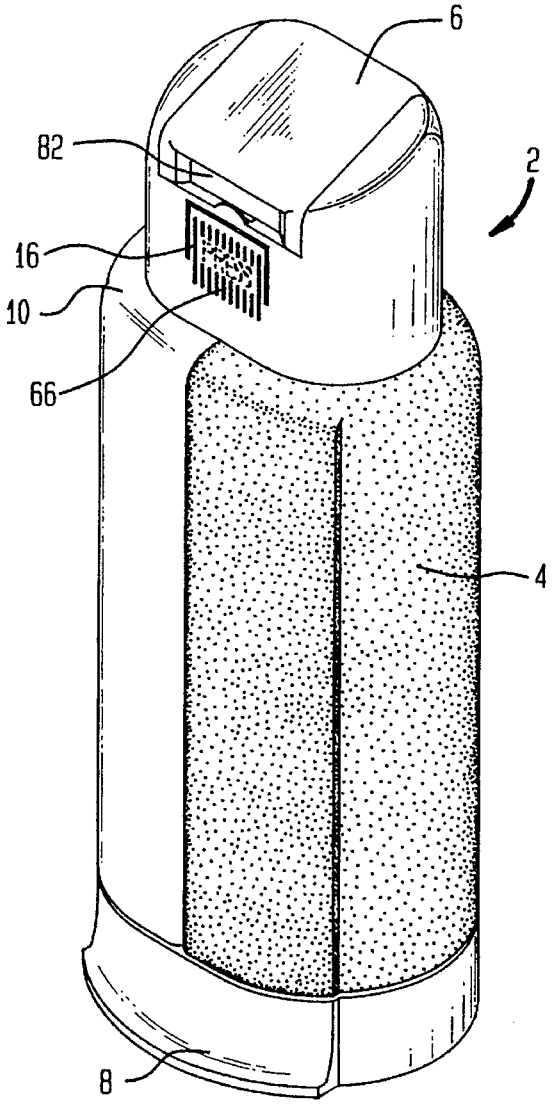
FIG. 1 is a perspective view of the dispensing package including cap and container according to the present invention.

A preferred embodiment of the present invention is shown in FIG. 1 where the dispensing package 2 is illustrated with a dual-compartment container 4 and a childproof dispensing cap 6. Container 4 has a closed end 8 and an open end 10 that surrounds a neck 12.

Figure 4:
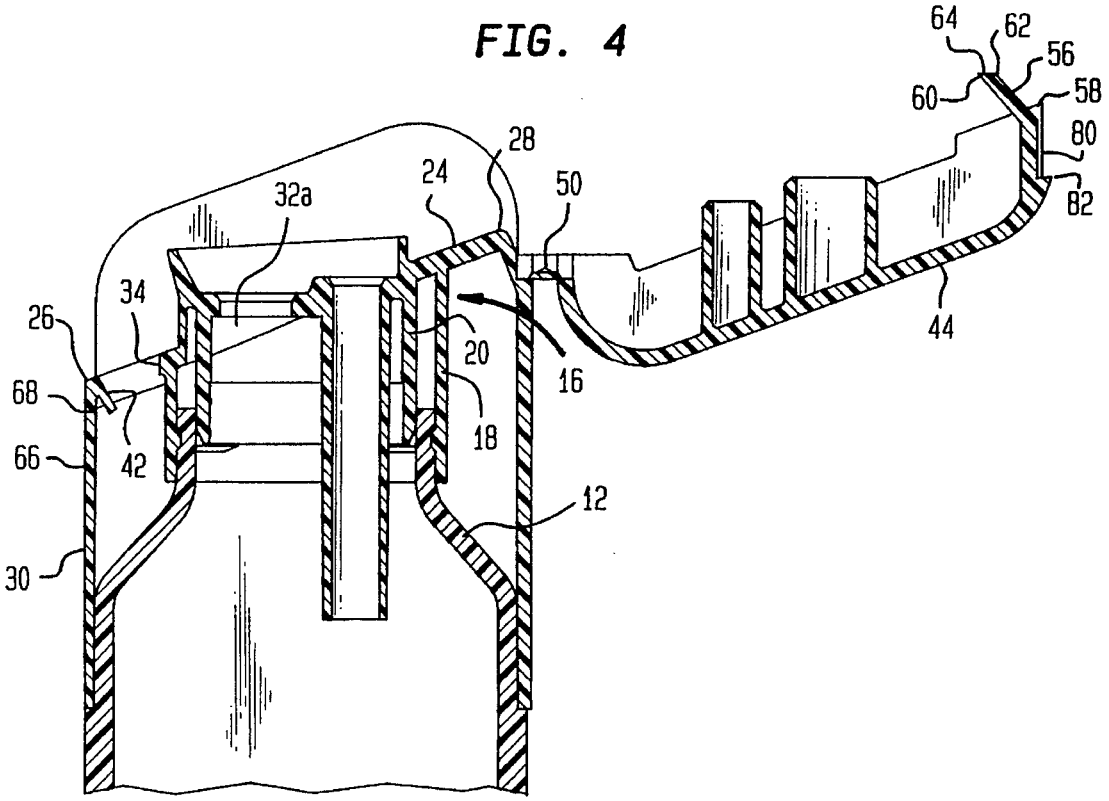
FIG. 4 is a fragmentary, cross-sectional view of the cap and container of FIG. 1, taken along line 4—4.
Figure 5:
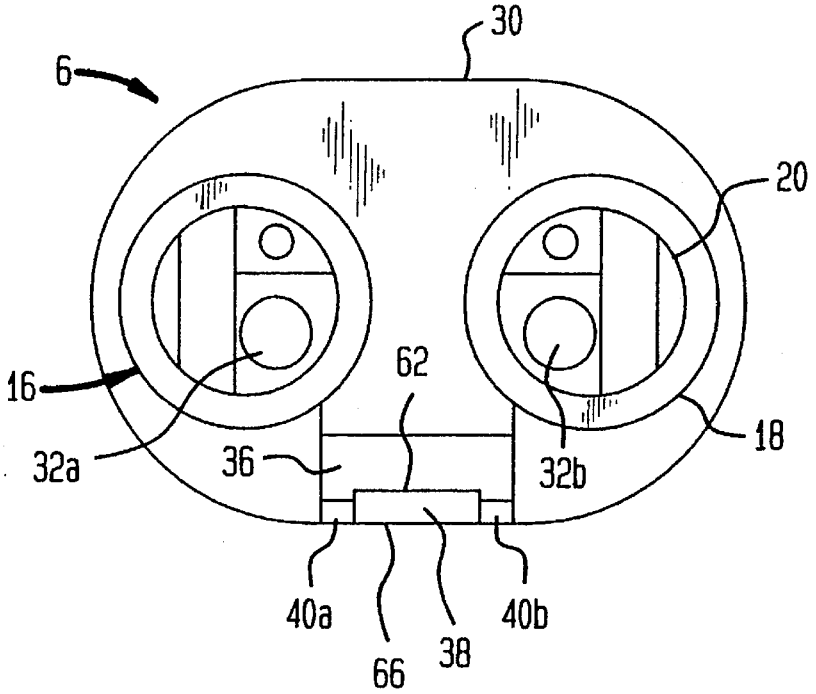
FIG. 5 is a bottom view of the cap as separated from the container of FIG. 1.

Cap 6 includes a base portion 14 having a mechanism to fittingly engage across open end 10 of the container 4. Mechanism 16 is shown in FIGS. 4 and 5 as concentric outer and inner sleeves 18 and 20 which snap-fit around neck 12 of the container.

A top portion 22 of cap 6 covers the base portion 14 and has a deck 24 along an upper surface thereof with front and rear edges 26, 28. A skirt wall 30 surrounds deck 24. A pair of dispensing orifices 32*a*, 32*b* are formed in deck 24. These orifices, surrounded by pour spouts 33*a*, 33*b*, allow product to be dispensed therethrough.

Figure 3:
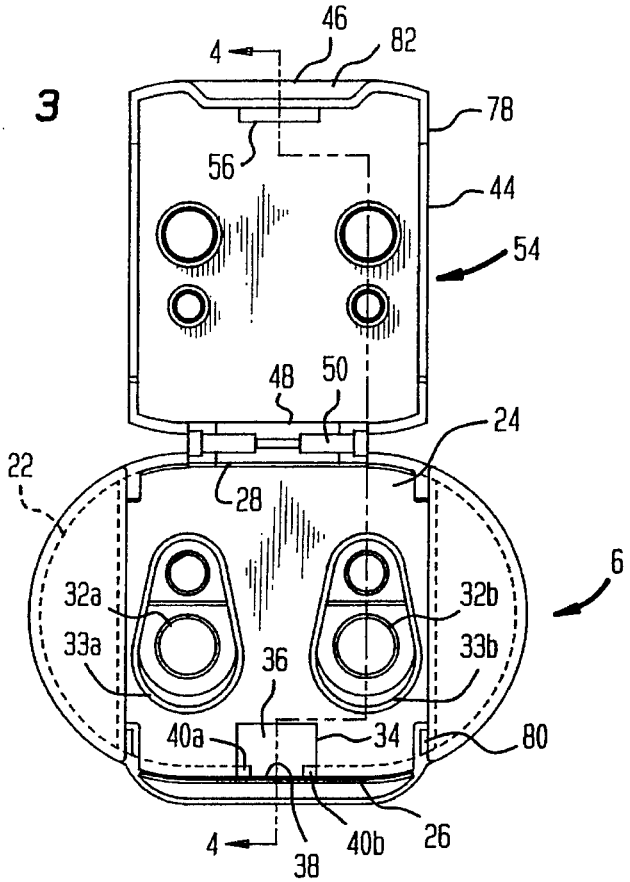
FIG. 3 is a top plan view of the fully opened cap detailing the inner surface of the lid and top surface of the deck.

A locking aperture 34 is formed in deck 24. The aperture includes a wide first area 36 and a narrow second area 38. As best illustrated in FIGS. 3 and 4, a pair of flanking landings 40*a*, 40*b* define the narrow second area 38. Each of the landings has an upper surface 42 bevelled downwardly away from deck 24. Locking aperture 34 is positioned adjacent the front edge 26 of deck 24. In the preferred embodiment, deck 24 is angled downwardly from rear edge 28 toward front edge 26.

Figure 2:
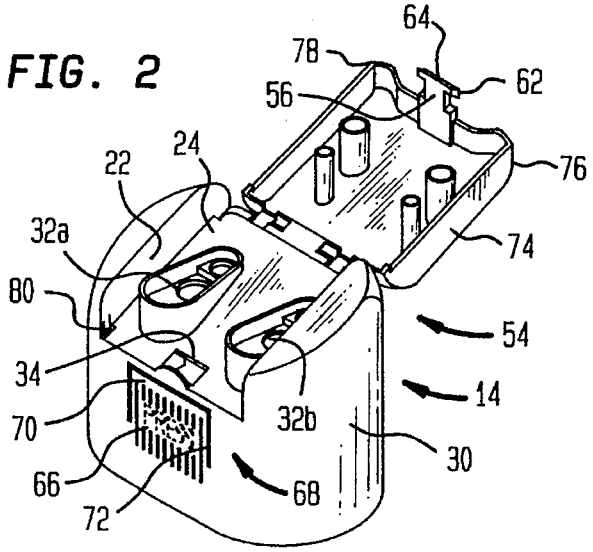
FIG. 2 is a perspective view of the cap with the lid in an open position.

A lid 44 with a front edge 46 and a rear edge 48 is attached through hinge 50 to cap 6 along rear edge 28 of the deck. FIG. 1 illustrates the lid in a closed position relative to the cap. FIGS. 2–4 illustrate the lid in varying open positions relative to the deck.

Projecting downwardly from the front edge 46 of the lid is a flexible post 56 with first and second ends 58, 60. The first end 58 is attached to the lid while the second end 60 is formed with an enlarged section 62 having a bevelled terminus 64. Enlarged section 62 is designed to be too wide to fit laterally within the narrow second area 38 of the locking aperture 34 but can be accommodated within the wide first area 36.

A release mechanism 66 is formed as an area on skirt wall 30. This area is partially severed from the skirt along a cut-line 68. The cut-line includes a horizontal cut 70 and a pair of parallel vertical cuts 72 perpendicularly intersecting ends of the horizontal cut.

A skirt wall 74 surrounds a top wall 76 of the lid 44. Post 56 is attached to lid skirt wall 74.

FIGS. 2 and 3 illustrate a pair of projections 78 at corners of the lid skirt wall 74. A corresponding pair of recesses 80 are formed into deck 24 near front edge 26 to engage and secure projections 78.

Closure of the cap involves hingedly pivoting lid 44 downward toward the deck 24. Flexible post 56 being aligned with the locking aperture 34 will contact landings 40*a*, 40*b* with its bevelled terminus 64. Pressure on the lid then forces the post to move resiliently in a flexing direction downwardly along the landings. Eventually the enlarged section moves beyond the landings into the wide first area of the locking aperture. Once past the landings, the post is free to return to a non-flexed position wherein the enlarged section lodges below the landings and a central narrow portion of the post is accommodated within the narrow second area of the aperture.

Figure 6:
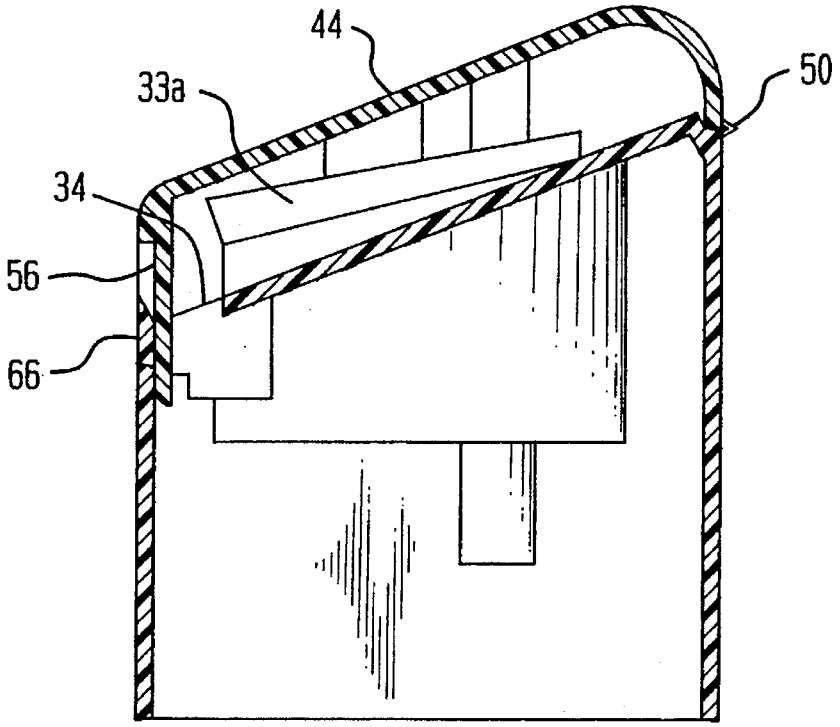
FIG. 6 is a cross-sectional view through the cap of FIG. 1 illustrating the locked position.
Figure 7:
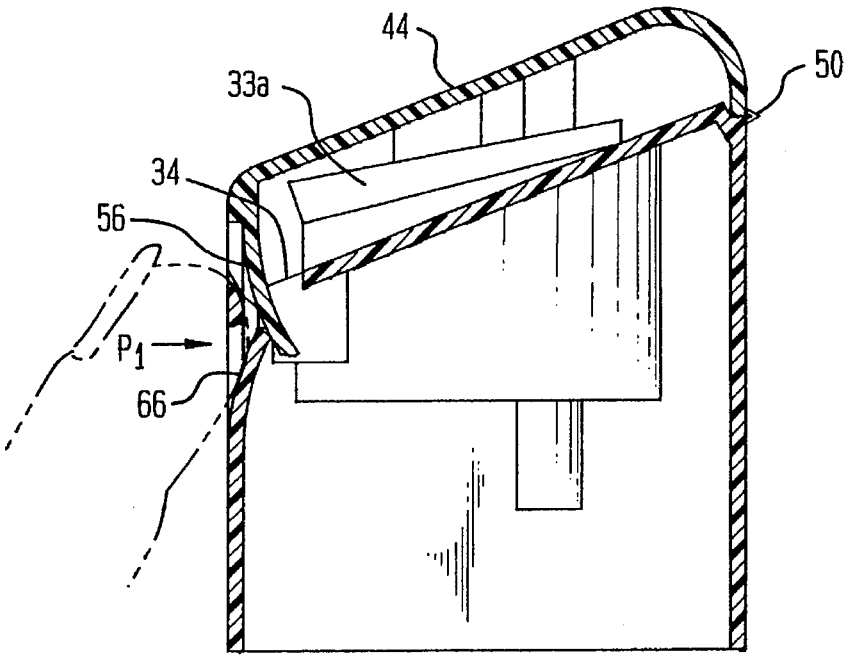
FIG. 7 is a cross-sectional view of the cap illustrating a finger pressing against the release mechanism deflecting the post.
Figure 8:
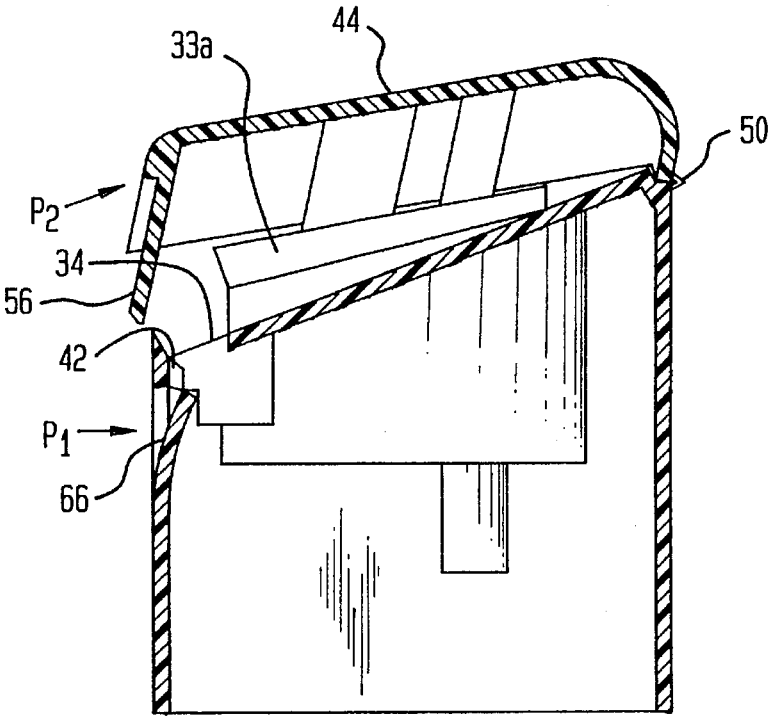
FIG. 8 is a cross-sectional view of the cap illustrating the post at the point of engagement/disengagement from the locking aperture.

Cap 6 is childproof because release of the lid requires thumb pressure against a resilient area along the front of the skirt outlined by the cut-line. FIGS. 6, 7 and 8 illustrate the sequence of unlocking the lid. Inward pressure $P_1$ on the release area, as shown in FIG. 7, results in contact with the enlarged section of the post thereby deflecting the enlarged section inwardly in the flexing direction to become disengaged from below the landings. Additional leverage is achieved by finger pressure against visor 82 jutting outward from lid skirt wall 74. Arrow $P_2$ of FIG. 8 best illustrates this action.

Figure 9:
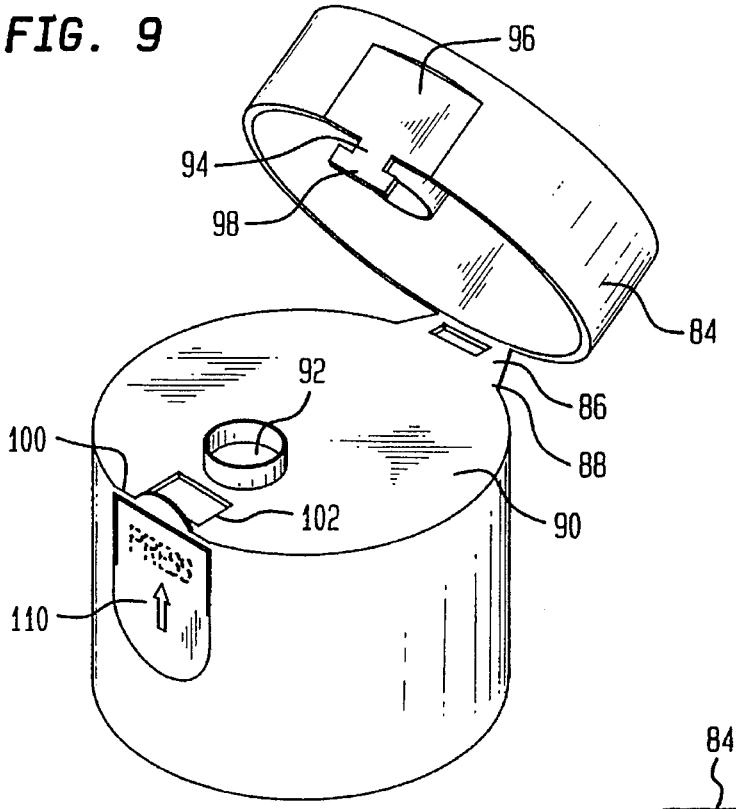
FIG. 9 is a second embodiment of the present invention showing a single dispensing orifice for a single chamber container in a perspective view of the cap with open lid.
Figure 10:
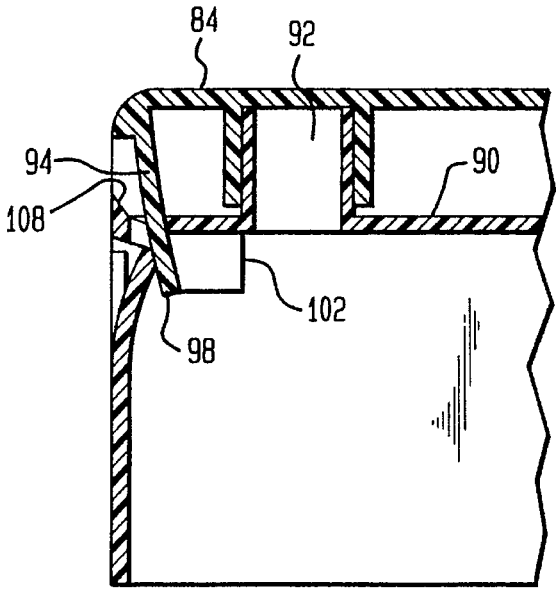
FIG. 10 is a cross-sectional view of the cap according to the second embodiment shown in FIG. 9.
Figure 11:
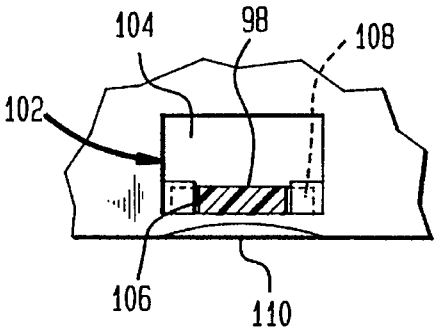
FIG. 11 is a fragmentary, top plan view of the locking aperture with the T-shaped/flexible post of the second embodiment according to FIG. 9 being in the locked position.
Figure 12:
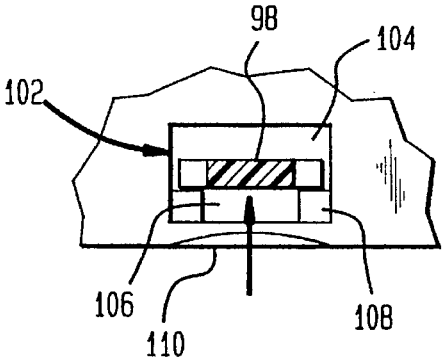
FIG. 12 is a fragmentary, top plan view of the locking aperture with the T-shaped flexible post of the second embodiment according to FIG. 9 being in the unlocked position.

FIG. 9–10 illustrate a second embodiment with a single dispensing orifice for use with a single chambered container. Lid 84 is swingably attached by hinge 86 to a rear edge 88 of deck 90. Dispensing orifice 92 is formed in the deck to allow product to pass therethrough from the container. Post 94 is attached to a front end 96 of the lid. An enlarged section 98 is formed at the end of the post distant from the lid. Near a front edge 100 of deck 90 is a locking aperture 102 formed with a wide area 104 and a narrow area 106, the latter being bordered by a pair of landings 108. In a locking position as shown in FIG. 11, the enlarged section 98 of post 94 is held below landings 108. FIG. 12 illustrates the unlocked position wherein pressure has been applied to the release mechanism 110.

It will be readily observed from the foregoing detailed description and embodiments that numerous variations and modifications may be effected without departing from the spirit and purview of the present invention.

What is claimed is:

1. A dispensing package comprising:

a container with a closed and an open end for storing a product; and a cap fitting across the open end of the container, the cap comprising:

a base portion with a means to fittingly engage across the open end of the container;

a top portion over the base portion having a deck along an upper surface thereof with front and rear edges;

a skirt wall surrounding the deck;

at least one dispensing orifice formed in the deck for allowing the product to be dispensed therethrough;

a locking aperture formed in the deck having a wide first area and a narrow second area;

a lid with a front and a rear end, the rear end being hingedly attached to the base portion;

a flexible post with first and second ends, the first end being attached to the lid, the second end being formed with an enlarged section with a size too wide to fit laterally within the narrow second area of the locking aperture, the post being adapted to move resiliently in a flexing direction as the lid is closed to reach a locked position wherein the enlarged section is lockingly received below the narrow second area; and a release means along the skirt for deflecting the enlarged section in the flexing direction to disengage same from below the landings.

2. A package according to claim 1 wherein the narrow second area is defined by a pair of flanking landings within the aperture.

3. A package according to claim 2 wherein each landing has an upper surface bevelled downwardly away from the deck.

4. A package according to claim 1 wherein the post is defined by four flat surfaced sides.

5. A package according to claim 1 wherein an end of the enlarged section of the post has a bevelled terminis.

6. A package according to claim 1 wherein the locking aperture is positioned adjacent the front edge of the deck.

7. A package according to claim 1 wherein the release means is an area on the skirt wall partially severed therefrom along a cut-line.

8. A package according to claim 7 wherein the cut-line includes a horizontal cut parallel to a front edge of the deck and a pair of parallel vertical cuts perpendicularly intersecting ends of the horizontal cut.

9. A package according to claim 1 wherein the deck is angled downwardly from rear to front edges.

10. A package according to claim 1 wherein the lid further comprises a skirt surrounding a top wall, the post being attached to the lid skirt.

11. A package according to claim 10 wherein a leading edge of the top wall projects outwardly over the lid skirt forming a visor.

12. A package according to claim 1 further comprising at least one projection on the lid oriented downward to engage at least one recess formed in the deck.

13. A package according to claim 1 wherein the dispensing orifice below the deck is encompassed by a downwardly oriented sleeve, the locking aperture being outside the encompassed sleeve.

14. A package according to claim 1 wherein the post is T-shaped.

15. A package according to claim 14 wherein the locking aperture is T-shaped.

* * * * *